US009166292B2

(12) United States Patent
Ho et al.

(10) Patent No.: US 9,166,292 B2
(45) Date of Patent: Oct. 20, 2015

(54) ANTENNA STRUCTURE AND WIRELESS COMMUNICATION DEVICE USING THE SAME

(71) Applicant: FIH (Hong Kong) Limited, Kowloon (HK)

(72) Inventors: Chao-Wei Ho, New Taipei (TW); Hao-Ying Chang, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 14/204,008

(22) Filed: Mar. 11, 2014

(65) Prior Publication Data

US 2014/0368402 A1 Dec. 18, 2014

(30) Foreign Application Priority Data

Jun. 17, 2013 (TW) ..... 102121437 A

(51) Int. Cl.
*H01Q 1/24* (2006.01)
*H01Q 9/04* (2006.01)
*H01Q 5/00* (2015.01)

(52) U.S. Cl.
CPC ..... *H01Q 9/0414* (2013.01); *H01Q 5/0058* (2013.01); *H01Q 9/0457* (2013.01); *H01Q 9/0471* (2013.01)

(58) Field of Classification Search
CPC ..... H01Q 5/30; H01Q 5/371; H01Q 5/364; H01Q 9/0414; H01Q 9/0471
USPC ..... 343/702, 860, 700 MS
See application file for complete search history.

(56) References Cited

U.S. PATENT DOCUMENTS

| | | | | |
|---|---|---|---|---|
| 2012/0050122 | A1* | 3/2012 | Wu et al. | 343/745 |
| 2012/0068887 | A1* | 3/2012 | Chiu et al. | 343/700 MS |
| 2012/0162017 | A1* | 6/2012 | Lee | 343/700 MS |
| 2012/0162043 | A1* | 6/2012 | Lee | 343/870 |

* cited by examiner

*Primary Examiner* — Dameon E Levi
*Assistant Examiner* — Collin Dawkins
(74) *Attorney, Agent, or Firm* — Novak Druce Connolly Bove + Quigg LLP

(57) ABSTRACT

An antenna structure includes a feed section, a ground section, a common section, a first radiator, a second radiator, and a third radiator. The common section is electrically connected to the feed section, and the third radiator is electrically connected to the ground section. The first radiator, the second radiator, and the third radiator are all connected to the common section. The second radiator is spaced from the third radiator to allow current to be coupled from the second radiator to the third radiator.

16 Claims, 3 Drawing Sheets

ANTENNA STRUCTURE AND WIRELESS COMMUNICATION DEVICE USING THE SAME

BACKGROUND

1. Technical Field

The disclosure generally relates to antenna structures, and particularly to an antenna structure for receiving/transmitting dual-band wireless signals or multiband wireless signals, and a wireless communication device using the same.

2. Description of Related Art

Antennas are used in wireless communication devices such as mobile phones. The wireless communication device uses a multiband antenna to receive/transmit wireless signals at different frequencies. However, many multiband antennas have complicated structures and are large in size, thereby making it difficult to miniaturize the wireless communication devices with which they are used.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
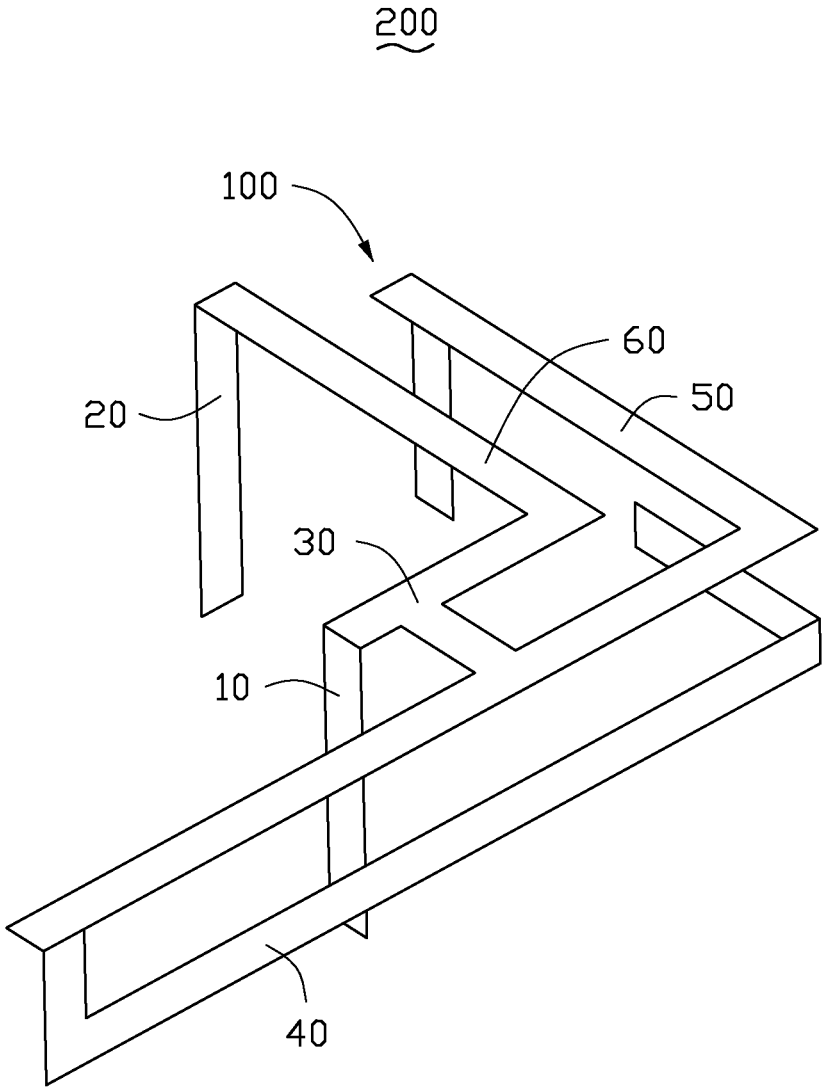
FIG. 1 is an isometric view of an embodiment of an antenna structure employed in an electronic device.

FIG. 1 shows an embodiment of a wireless communication device 200 employing an antenna structure 100. The wireless communication device 200 can be a mobile phone or a personal digital assistant, for example (details not shown).

The antenna structure 100 includes a feed section 10, a ground section 20, a common section 30, a first radiator 40, a second radiator 50, and a third radiator 60.

The feed section 10 provides current to the antenna structure 100, and the antenna structure 100 is grounded by the ground section 20.

Figure 2:
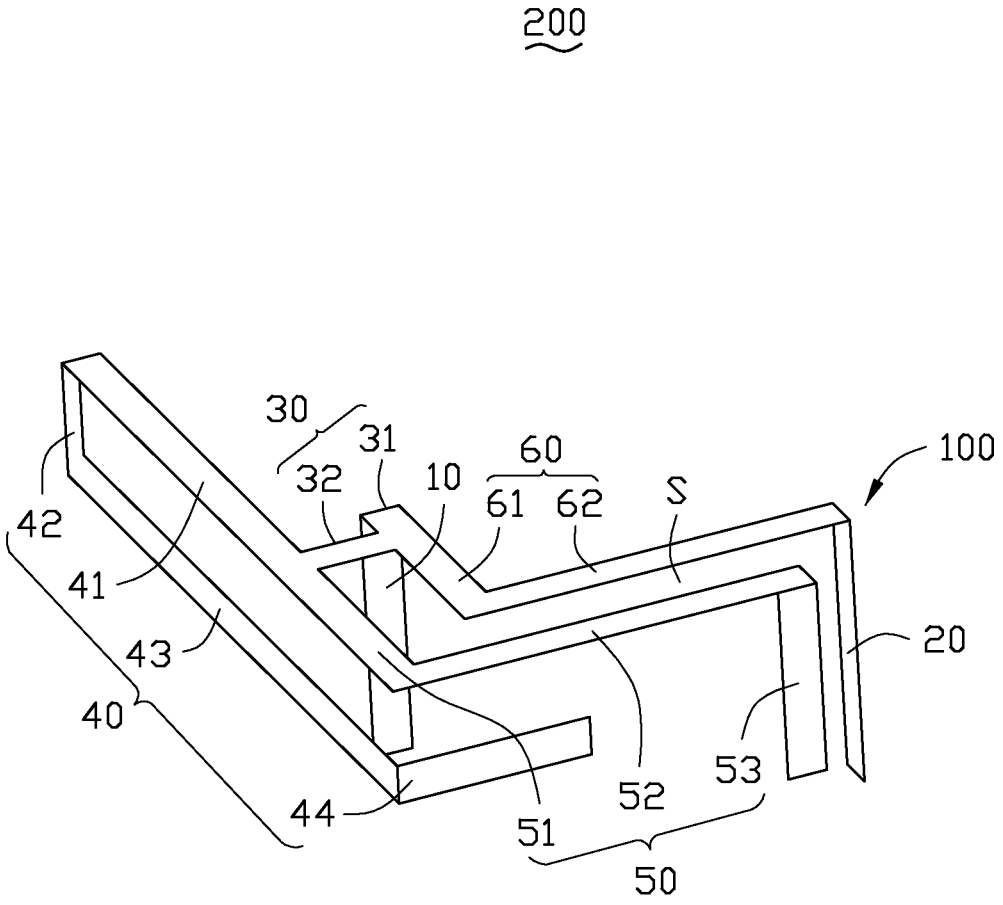
FIG. 2 is similar to FIG. 1, but shown from another aspect.

Referring to FIG. 2, the common section 30 is substantially an L-shaped strip. The common section 30 is configured to match an impedance of the antenna structure 100. The common section 30 includes a first common strip 31 and a second common strip 32 substantially coplanar with the first common strip 31. The first common strip 31 is connected substantially perpendicularly to the feed section 10, and the second common strip 32 is connected substantially perpendicularly to the first common strip 31.

The first radiator 40 includes a first extending strip 41, a second extending strip 42, a third extending strip 43, and a fourth extending strip 44. The first extending strip 41 is substantially coplanar with the second common strip 32. The first extending strip 41 is connected substantially perpendicularly to the second common strip 32, and extends substantially parallelly to the first common strip 31. The second extending strip 42 is connected substantially perpendicularly between the first extending strip 41 and the third extending strip 43. A plane of the third extending strip 43 is substantially coplanar with a plane of the second extending strip 42, and an extending direction of the third extending strip 43 is substantially parallel to an extending direction of the first extending strip 41. The fourth extending strip 44 is connected substantially perpendicularly to the third extending strip 43.

The second radiator 50 includes a first connection strip 51, a second connection strip 52, and a third connection strip 53. The first connection strip 51 is substantially coplanar with and connected substantially perpendicularly to the second common strip 32. The first connection strip 51 extends continuously from the first extending strip 41. An end of the first connection strip 51 away from the first extending strip 41 aligns with an end of the third extending strip 43. The second connection strip 52 is connected substantially perpendicularly between the first connection strip 51 and the third connection strip 53. The second connection strip 52 is substantially coplanar with the first connection strip 51, and extends along a direction substantially parallel to an extending direction of the fourth extending strip 44. A plane of the third connection strip 53 is substantially perpendicular to a plane of the second connection strip 52.

The third radiator 60 includes a first radiation strip 61 and a second radiation strip 62. The first radiation strip 61 extends continuously from the first common strip 31, and is spaced from the first connection strip 51. The second radiation strip 62 is connected substantially perpendicularly between the first radiation strip 61 and the ground section 20, and is spaced from the second connection strip 52. Thus, the first radiation strip 61, the second radiation strip 62, the first connection strip 51, and the second connection strip 52 cooperatively define an L-shaped slot S.

When current is input to the feed section 10, the current flows to the common section 30. A first portion of the current flows to the first extending strip 41, the second extending strip 42, the third extending strip 43, and the fourth extending strip 44, thereby activating the first radiator 40 to receive and transmit first wireless signals, such as GPS signals (1.575 GHz). A second portion of the current flows to the first connection strip 51, the second connection strip 52, and the third connection strip 53, thereby activating the second radiator 50 to receive and transmit second wireless signals, such as WiFi-2.4 G signals (2.402 GHz-2.482 GHz). A third portion of the current flows to the first radiation strip 61 and the second radiation strip 62, thereby activating the third radiator 60. The third radiator 60 is coupled to the second radiator 50 via the slot S for cooperatively receiving and transmitting third wireless signals, such as WiFi-5 G signals (5.150 GHz-5.875 GHz).

Figure 3:
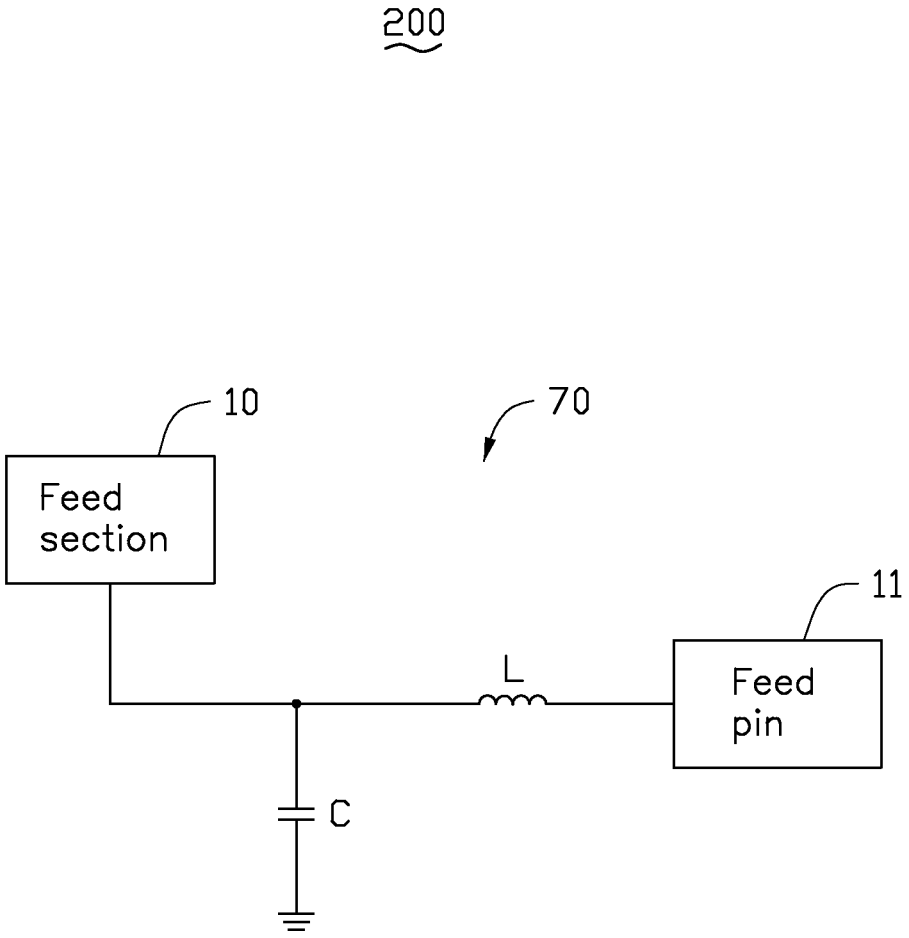
FIG. 3 is a circuit diagram of a matching circuit of the wireless communication device of FIG. 1.

Referring to FIG. 3, the wireless communication device 200 further includes a matching circuit 70. The matching circuit 70 is configured to match impedance of the third radiator 60, for optimizing performance of the antenna structure 100 when the antenna structure 100 transmits or receives the third wireless signals. The matching circuit 70 is electronically connected between a feed pin 11 of the wireless communication device 200 and the feed section 10.

The matching circuit 70 includes a capacitor C and an inductor L. The inductor L is electronically connected between the feed pin 11 and the feed section 10. A first end of the capacitor C is electronically connected between the feed section 10 and the inductor L, and a second end of the capacitor C is grounded. In one exemplary embodiment, the capacitor C is about 0.2 PF, and the inductor L is about 1.8 nH. By adjusting a capacitance of the capacitor C and an inductance of the inductor L, the impedance of the third radiator 60 can be matched to optimize performance of the antenna structure 100. Thus, the antenna structure 100 can be used to receive and transmit the third wireless signals, such as WiFi-5 G signals, for example.

In summary, the second radiator 50 is coupled to the third radiator 60 to allow the antenna structure 100 to receive/transmit dual-band wireless signals or multiband wireless signals. Thus, the wireless communication device 200 does not require any additional antennas, which effectively reduces a required size of the wireless communication device 200. In addition, a radiating capability of the antenna structure 100 of the wireless communication device 200 is effectively improved because of the matching circuit 70.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:
a feed section;
a ground section;
a common section connected to the feed section;
a first radiator;
a second radiator comprising a first connection strip and a second connection strip; and
a third radiator connected to the ground section, the third radiator comprising a first radiation strip and a second radiation strip;
wherein all of the first radiator, the second radiator, and the third radiator are connected to the common section, the second radiator is spaced from the third radiator to allow current to be coupled from the second radiator to the third radiator; and
wherein the first connection strip is connected to the common section, the second connection strip is perpendicularly connected to the first connection strip; and
wherein the first radiation strip is perpendicularly connected to the common section, the second radiation strip is perpendicularly connected to the first radiation strip; and
wherein the first radiation strip is parallel to the first connection strip, and the second radiation strip is parallel to the second connection strip.

2. The antenna structure as claimed in claim 1, wherein the common section comprises a first common strip and a second common strip positioned coplanar with the first common strip, the first common strip is perpendicularly connected to the feed section, and the second common strip is perpendicularly connected to the first common strip.

3. The antenna structure as claimed in claim 2, wherein the first radiator comprises a first extending strip, a second extending strip, and a third extending strip, the first extending strip is positioned coplanar with the second common strip, the first extending strip is perpendicularly connected to the second common strip, and extends substantially parallel to the first common strip, the second extending strip is perpendicularly connected between the first extending strip and the third extending strip, the third extending strip is positioned coplanar with the second extending strip, and extends along the first extending strip.

4. The antenna structure as claimed in claim 3, wherein the first radiator further comprises a fourth extending strip, the fourth extending strip is perpendicularly connected to the third extending strip.

5. The antenna structure as claimed in claim 4, wherein the second radiator further comprises a third connection strip, the first connection strip is positioned coplanar with the second common strip, the first connection strip is perpendicularly connected to the second common strip, and extends in a direction opposite to the first extending strip until the first connection strip aligns with an end of the third extending strip, the second connection strip is perpendicularly connected between the first connection strip and the third connection strip, the second connection strip is positioned coplanar with the first connection strip, and extends along the fourth extending strip, the third connection strip is positioned on a plane that is substantially perpendicular to the plane in which the second connection strip is positioned.

6. The antenna structure as claimed in claim 5, wherein the first radiation strip extends from the first common strip, and is spaced from the first connection strip, the second radiation strip is perpendicularly connected between the first radiation strip and the ground section, and is spaced from the second connection strip.

7. The antenna structure as claimed in claim 1, wherein the first radiation strip, the second radiation strip, the first connection strip, and the second connection strip cooperatively form a L-shaped slot.

8. A wireless communication device, comprising:
an antenna structure, the antenna structure comprising:
a feed section;
a ground section;
a common section connected to the feed section;
a first radiator connected to the common section;
a second radiator comprising a first connection strip and a second connection strip perpendicularly connected to the first connection strip; and
a third radiator connected to the ground section, the third radiator comprising a first radiation strip and a second radiation strip, the first connection strip connected to the common section, the first radiation strip perpendicularly connected to the common section, the first radiation strip parallel to the first connection strip, the second radiation strip perpendicularly connected to the first radiation strip and parallel to the second connection strip;
wherein a slot is defined between the second radiator and the third radiator, current is coupled from the second radiator to the third radiator.

9. The wireless communication device as claimed in claim 8, wherein the common section comprises a first common strip and a second common strip positioned coplanar with the first common strip, the first common strip is perpendicularly connected to the feed section, and the second common strip is perpendicularly connected to the first common strip.

10. The wireless communication device as claimed in claim 9, wherein the first radiator comprises a first extending strip, a second extending strip, and a third extending strip, the first extending strip is positioned coplanar with the second common strip, the first extending strip is perpendicularly connected to the second common strip, and extends substantially parallel to the first common strip, the second extending strip is perpendicularly connected between the first extending strip and the third extending strip, the third extending strip is positioned coplanar with the second extending strip, and extends along the first extending strip.

11. The wireless communication device as claimed in claim 10, wherein the first radiator further comprises a fourth extending strip, the fourth extending strip is perpendicularly connected to the third extending strip.

12. The wireless communication device as claimed in claim 11, wherein the second radiator further comprises a third connection strip, the first connection strip is positioned coplanar with the second common strip, the first connection strip is perpendicularly connected to the second common strip, and extends in a direction opposite to the first extending strip until the first connection strip aligns with a distal end of the third extending strip, the second connection strip is perpendicularly connected between the first connection strip and the third connection strip, the second connection strip is positioned coplanar with the first connection strip, and extends along the fourth extending strip, the third connection strip is positioned on a plane that is substantially perpendicular to the plane in which the second connection strip is positioned.

13. The wireless communication device as claimed in claim 12, wherein the first radiation strip extends from the first common strip, and is spaced from the first connection strip, the second radiation strip is perpendicularly connected between the first radiation strip and the ground section, and is spaced from the second connection strip.

14. The wireless communication device as claimed in claim 8, wherein the first radiation strip, the second radiation strip, the first connection strip, and the second connection strip cooperatively form the slot.

15. The wireless communication device as claimed in claim 8, further comprising a matching circuit and a feed pin, the matching circuit is electronically connected between the feed pin and the feed section.

16. The wireless communication device as claimed in claim 15, wherein the matching circuit comprises a capacitor and an inductor, the inductor is electronically connected between the feed pin and the feed section, a first end of the capacitor is electronically connected between the feed section and the inductor, a second end of the capacitor is ground.

* * * * *